United States Patent [19]

Barker

[11] Patent Number: 4,939,543

[45] Date of Patent: Jul. 3, 1990

[54] IONOGRAPHIC OZONE FILTERING SYSTEM

[75] Inventor: Laurence S. Barker, Fairport, N.Y.

[73] Assignee: Xerox Corporation, Stamford, Conn.

[21] Appl. No.: 242,768

[22] Filed: Sep. 12, 1988

[51] Int. Cl.[5] ..... G03G 21/00; G03G 15/00; G03G 15/02

[52] U.S. Cl. ..... 355/215; 355/210; 355/219; 355/297; 355/298; 346/159

[58] Field of Search ..... 355/30, 210, 211, 215, 355/219, 297, 298; 204/176; 55/387, 473; 346/159

[56] References Cited

U.S. PATENT DOCUMENTS

| | | | |
|---|---|---|---|
| 3,675,096 | 7/1972 | Kiess | 317/262 A |
| 3,767,300 | 10/1973 | Brown et al. | 355/15 |
| 4,202,618 | 5/1980 | Waschk et al. | 355/3 FU |
| 4,264,184 | 4/1981 | Nishikawa et al. | 355/3 R |
| 4,401,385 | 8/1983 | Katayama et al. | 355/15 |
| 4,540,268 | 9/1985 | Toyono et al. | 355/3 R |

FOREIGN PATENT DOCUMENTS 3026969 2/1981 Fed. Rep. of Germany .

*Primary Examiner*—A. T. Grimley
*Assistant Examiner*—Nestor R. Ramirez
*Attorney, Agent, or Firm*—Ronald F. Chapuran

[57] ABSTRACT

An air jet assisted ion projection machine including an image bearing member, an ion generator, an inlet channel and an outlet channel connected to the ion generator, a source of air in communication with the inlet channel to move ions through the outlet channel, the outlet channel being located near the image bearing member, modulation means located adjacent the outlet channel for controlling the passage of ions therethrough to the image bearing member, and an ozone filter system for filtering ozone generated within the machine, the ozone filtering system comprising an ozone filter supported within the machine, and an air path defined by the machine geometry between the outlet channel and the ozone filter, the source of air for moving ions also conveying ozone in the air path to the ozone filter.

6 Claims, 2 Drawing Sheets

IONOGRAPHIC OZONE FILTERING SYSTEM

BACKGROUND OF THE INVENTION

The present invention relates to a process and apparatus for filtering, and more particularly, for filtering ozone laden air in an ionographic imaging apparatus.

An ionographic imaging apparatus is generally a printer having an ion projection means for projecting ions upon a charge receptor surface having an ion generator, an inlet channel and an outlet channel connected to the ion generator, a source of transport fluid in communication with the inlet channel for delivering transport fluid to move ions through the outlet channel, and modulation means located adjacent the outlet channel for controlling the passage of ions therethrough to the charge receptor.

It is generally essential in such machines in commercial use to decompose and dissipate ozone to comply with machine ozone emission standards. Also, the accumulation of ozone in a machine can result in the degradation and deterioration of machine components.

It is well known in the art to filter ozone emissions. For example, U.S. Pat. No., 4,202,618 discloses a method to prevent ozone emission to a machine exterior. It is achieved by use of an activated carbon filter. A fan guides the contaminated air to the air filter. After passing through the filter, the air is eventually mixed with cooler air emitted from the electronics compartment of the machine.

U.S. Pat. No. 3,767,300 discloses a pollution control system for a photocopying machine. Contaminates are passed through a cold trap to produce a condensate which is mixed with the carrier liquid and water and separated out.

It is also known, as disclosed in U.S. Pat. No. 4,540,268, to use an ozone filter in a removable process kit in an electrophotographic copying apparatus. In particular, an air differential is provided by a fan to convey ozone laden air to a filter secured in the removable process kit.

Also, U.S. Pat. No. 4,401,385 to Katayama et al. and German Laid-Open Patent No. 3,026,969 disclose the use of an ozone filtering mechanism. U.S. Pat. No. 4,264,184 to Nishikawa et al. and U.S. Pat. No. 3,675,096 to Kiess disclose the removal of ozone by a catalyst device.

The above described prior art devices relate to electrophotographic copier devices, and, in general, require an independent source of fluid or air flow such as a fan to convey generated ozone to a suitable filter. This often requires separate ducting or channels for the necessary air flow path. The independent source of air and separating ducting can be relatively complex and expensive. It is an object, therefore, of the present invention to provide a simple and inexpensive means to filter ozone in an ionographic imaging apparatus, in particular, using the ionographic source of transport fluid and ionographic machine geometry to convey generated ozone to an ozone filter. Further advantages of the present invention will become aparent as the following description proceeds and the features characterizing the invention will be pointed out with particularity in the claims annexed to and forming a part of this specification.

SUMMARY OF THE INVENTION

Briefly, the present invention is an air jet assisted ion projection machine including an image bearing member, an ion generator, an inlet channel and an outlet channel connected to the ion generator, a source of air in communication with the inlet channel to move ions through the outlet channel, the outlet channel being located near the image bearing member, modulation means located adjacent the outlet channel for controlling the passage of ions therethrough to the image bearing member, and an ozone filter system for filtering ozone generated within the machine the ozone filtering system comprising an ozone filter supported within the machine, and an air path defined by the machine geometry between the outlet channel and the ozone filter, the source of air for moving ions also conveying ozone in the air path to the ozone filter.

DESCRIPTION OF THE DRAWINGS

For a better understanding of the present invention, reference may be had to the accompanying drawings wherein the same reference numerals have been applied to like parts and wherein.

DETAILED DESCRIPTION OF THE INVENTION

Figure 1:
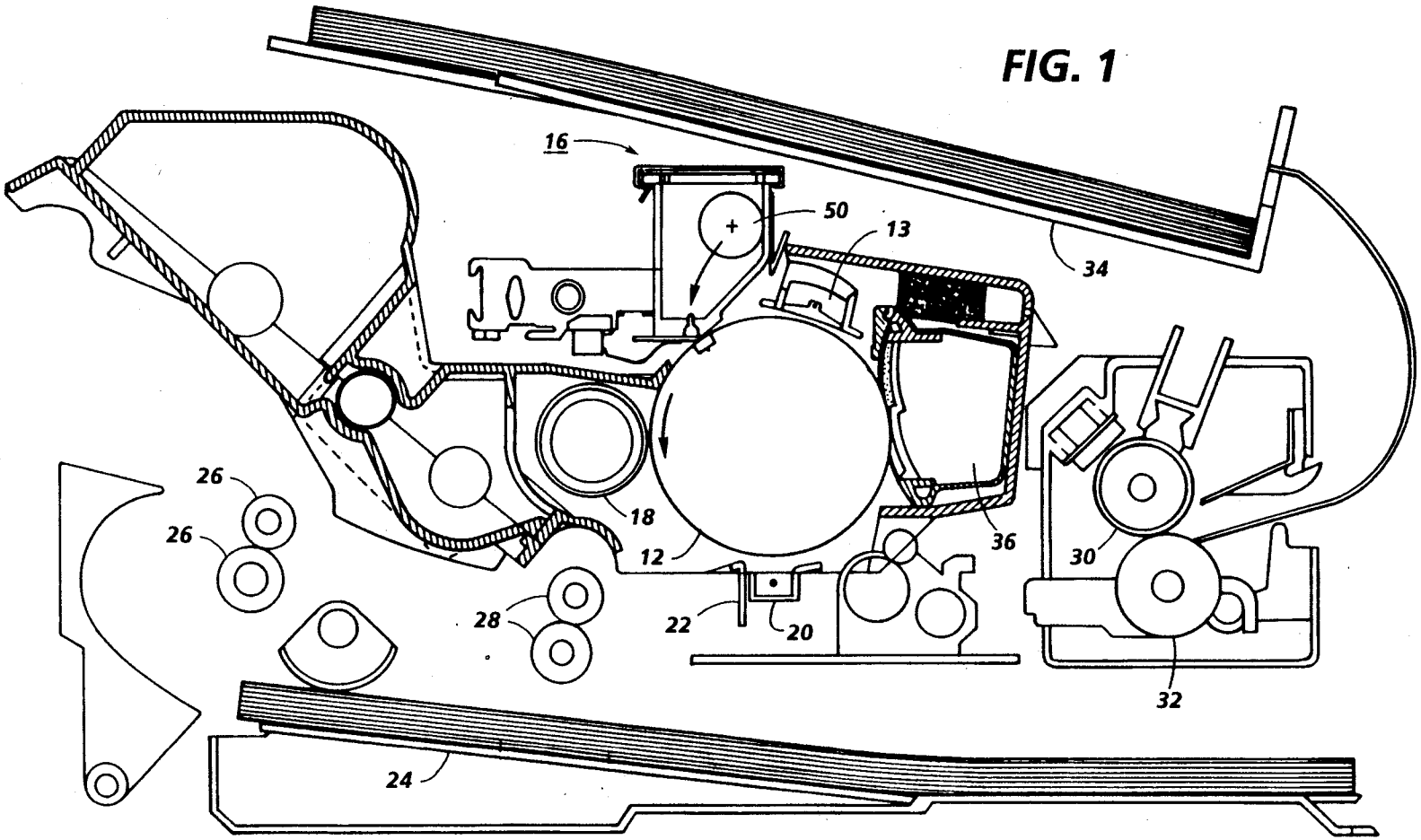
FIG. 1 is an elevational view depicting an ionographic printing machine incorporating the present invention.
Figure 2:
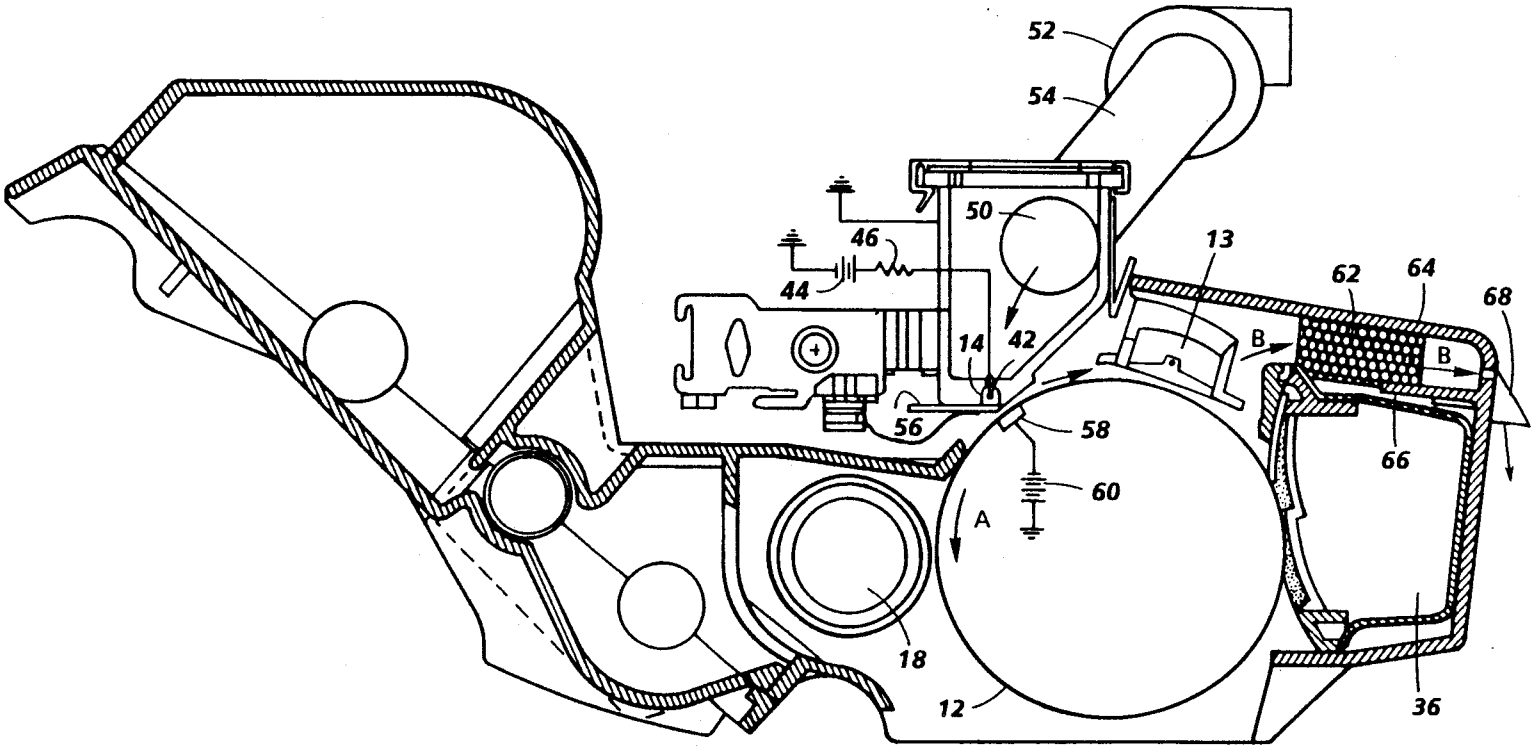
FIG. 2 is an enlarged view of the ozone filter system in accordance with the present invention.

With reference to FIGS. 1 and 2, there is shown a typical printing apparatus that could incorporate the present invention. In particular, the apparatus includes a receiver 12, a substrate supporting any suitable electrostatic material, is charged to a background voltage, in a preferred embodiment approximately −1500 volts, by a charging scorotron 13. The receiver 12 is rotated in a direction of the arrow A passed the outlet channel 14 of fluid jet assisted ion projection apparatus generally shown at 16. A charge pattern corresponding to an image to be reproduced is projected onto the surface of the receiver 12 providing a latent image. Upon further rotation of the receiver to a developer station, suitable developer rolls 18, such as magnetic development rolls, advance a developer material into contact with the electrostatic latent image. The latent image attracts toner particles from the carrier granules of the developer material to form a toner powder image upon the surface of the receiver. It should be noted that a single component development system could be used as well.

The receiver 12 then advances to a transfer station where a copy sheet is moved into contact with the powder image. The transfer station includes a transfer corotron 20 for spraying ions onto the backside of the copy sheet and also includes a pretransfer baffle 22. Copy sheets are fed from selected trays, for example, tray 24 and conveyed through a suitable copy sheet paper path, driven by suitable rolls such as rolls 26 and 28 to the transfer station.

After transfer, the copy sheets are driven to a fuser station including fusing rolls for permanently affixing the transferred powder image to the copy sheets. Preferably, the fuser assembly includes a heated fuser roll 30 and backup or pressure roll 32 with the sheet passing therebetween. After fusing, the copy sheet is transported to a suitable output tray such as illustrated at 34.

In addition, a suitable cleaner 36, for example, a blade cleaner in contact with the receiver surface removes residual particles from the surface.

A typical ion projection apparatus 16 includes an electrically conductive, elongated chamber 40 and a corona discharge wire 42 extending along the length of the chamber 40. A high potential source 44 on the order of several thousand volts d.c. is connected to the wire 42 through a suitable load resistor 46 and a reference potential source 48 (which may be ground) is connected to the wall of chamber 40. Upon application of the high potential to corona discharge wire 42, a corona discharge surrounds the wire, creating a source of ions of a given polarity (preferably positive), which are attracted to the grounded chamber wall and fill the chamber with a space charge.

An inlet channel 50 delivers pressurized transport fluid (preferably air) into the chamber 40 from a suitable source such as blower 52 connected to the channel 50 by the tube 54. The outlet channel 14 from the chamber 40 extends to the receiver 12 for conducting the ion laden transport fluid to the receiver 12. The outlet channel 14 communicates with a marking head 56 spaced from the projecting apparatus 16 to provide the passageway to the receiver 12. As the ion laden transport fluid passes through the outlet 14, it flows over an array of ion modulation electrodes integrally formed on the marking head 56.

Ions allowed to pass completely through the outlet channel 14 come under the influence of accelerating back electrode 58 which is connected to a high potential source 60 on the order of several thousand volts d.c. of a sign opposite to that of the corona source 44. The insulating charge receiver 12 is interposed between the accelerating back electrode and the housing, and is moved over the back electrode for collecting the ions upon its surface in an image configuration. Once the ions have been swept into the outlet channel 14 by the transport fluid, it becomes necessary to render the ion laden fluid stream intelligible. This is accomplished by selectively controlling the potential on modulation electrodes by any suitable means. For further details of the ion projection apparatus 16 and control of the modulation electrodes, reference is made to U.S. Pat. No. 4,584,592 and U.S. Pat. No. 4,463,363 incorporated herein.

In accordance with the present invention, an ozone decomposing filter 62 is suitably disposed in the printing apparatus as illustrated, between the walls 64 and 66 of the printing apparatus and near the charging scorotron 13. The printing apparatus employs the charge scorotron 13 and the corona discharge wire 42 to charge and selectively discharge the image receiver 12. In operation both the scorotron 13 and the discharge wire 42 generate ozone. Decomposition of the ozone is achieved by passing the ozone laden air through the filter 62 which is preferably a non-woven polyester, a polyester-polyether foam or any other suitable porous material. The source of the air to carry the ozone through the ozone filter 62 is the blower 52, a centrifugal fan or any other suitable source of air pressure.

In operation, the blower 52 delivers pressurized air into the chamber 40 via the tube 54. and channel 50. The flow of the pressurized ion laden air then generally follows the arrows B to the outlet channel 14, along the receiver 12, through the charging scorotron 13 to the filter 62. As the air continues its flow out through vent 68 to the inside of the printing apparatus, the ozone is decomposed to acceptable limits within filter 62. The blower 52, thus provides the dual role of source of the pressurized fluid to convey ionized air selectively to the receiver 12 and source of pressurized fluid to convey ozone laden air to ozone decomposing filter 62.

It should also be noted that the filter 62 is disposed in a removable and disposable cartridge. In particular, the removable cartridge includes the portion of the imaging unit as shown in FIG. 2, the receiver 12, the developer including developer rolls 18, the charging scorotron 13, the cleaner 36 and the filter 62, exclusive of the ion projection apparatus 16. The removable and disposable cartridge is replaced upon the appropriate notice or measurement of machine usage, such as the the reproduction or printing of a pre-determined number of copies or the usable or functional life of the cartridge, as determined by amount of toner. Upon replacement of the cartridge, the printing apparatus will be equipped with a new ozone filter 62 as well as a new developer system, charging scorotron, receiver, and cleaner.

By a suitable selection of an ozone filter, the maintenance or replacement of the filter will be accomplished by the replacement of the cartridge. It should also be noted that it is within the scope of the present invention to position the filter at any suitable location within the printing apparatus as long as the filter is in the path of the ozone laden air to sufficiently decompose the ozone laden air to acceptable limits.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A fluid jet assisted ion projection machine for providing latent images on an image bearing member comprising:

an ion generator, an inlet channel and an outlet channel connected to the ion generator, a source of transport fluid in communication with the inlet channel for delivering transport fluid to move ions through the outlet channel, the outlet channel being located near the image bearing member, modulation means located adjacent the outlet channel for controlling the passage of ions therethrough to the image bearing member, an ozone filter supported within the machine, a transport fluid path disposed between the outlet channel and the ozone filter, and a source of generated ozone disposed within the transport fluid path, the transport fluid conveying the ozone in the transport fluid path to the ozone filter.

2. The machine of claim 1 including a developer for rendering visible the latent images on the image bearing member, the developer being part of a replaceable cartridge in the ion projection machine, said ozone filter being secured to the replaceable cartridge.

3. The machine of claim 1 including a charging device to charge the image bearing member, the transport fluid path extending through the charging device to the ozone filter.

4. The machine of claim 3 wherein the charging device is a charge scorotron.

5. The machine of claim 4 wherein the ozone filter is a non-woven polyester coated filter and or polyester-polyether foam and the source of transport fluid is a centrifugal blower.

6. In an air jet assisted ion projection machine, the machine including:

an image bearing member, an ion generator, an inlet channel and an outlet channel connected to the ion generator, a source of air in communication with the inlet channel to move ions through the outlet channel, the outlet channel being located near the image bearing member, modulation means located adjacent the outlet channel for controlling the passage of ions therethrough to the image bearing member, and an ozone filter system for filtering ozone generated within the machine comprising:

an ozone filter supported within the machine, and an air path disposed between the outlet channel and the ozone filter, the source of air for moving ions also conveying ozone in the air path to the ozone filter.

* * * * *